United States Patent [19]

King

[11] 4,377,219

[45] Mar. 22, 1983

[54] LOUDSPEAKER HAVING APERTURED ACOUSTIC IMPEDANCE FRONTAL LOADING ELEMENT

[75] Inventor: John A. King, Martinsville, Ind.

[73] Assignee: Harman International Industries, Northridge, Calif.

[21] Appl. No.: 255,400

[22] Filed: Apr. 20, 1981

[51] Int. Cl.[3] ..... H04R 7/00

[52] U.S. Cl. ..... 181/155

[58] Field of Search ..... 179/180; 181/146, 148, 181/151, 155, 166, 175

[56] References Cited

U.S. PATENT DOCUMENTS 2,672,525 3/1954 Pye ..... 179/180 X 2,840,178 6/1958 Boleslav ..... 181/155

4,058,688 11/1977 Nishimura et al. ..... 179/180 X

*Primary Examiner*—L. T. Hix

*Assistant Examiner*—Thomas H. Tarcza

*Attorney, Agent, or Firm*—Barnes & Thornburg

[57] ABSTRACT

A direct radiating dynamic loudspeaker has an apertured impedance frontal loading element for improving its acoustic impedance. A planar sheet of nonrigid, fibrous air-permeable material has an apertured area and is positioned in front of the diaphragm of the loudspeaker. The sheet of air-permeable material is supported only at its periphery. A sheet of acoustically transparent material is bonded to the sheet of air-permeable material to cover the apertured area.

13 Claims, 3 Drawing Figures

FIG. 1
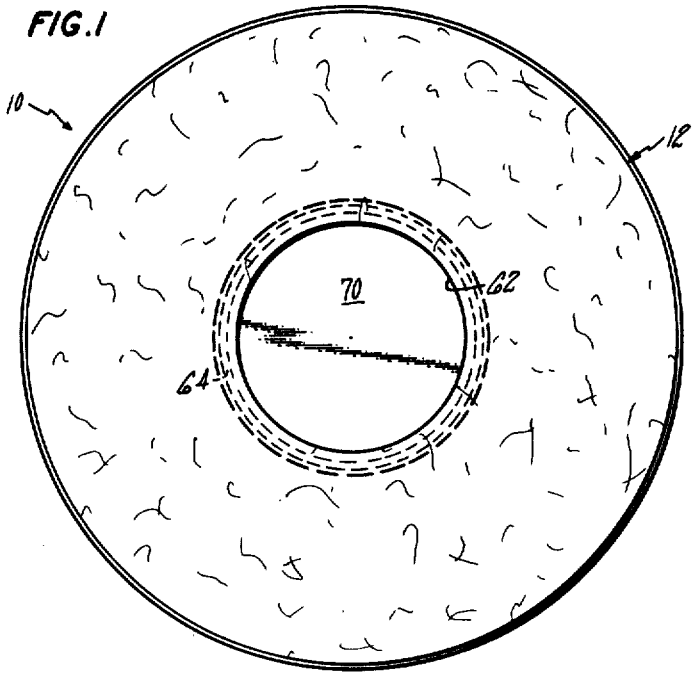
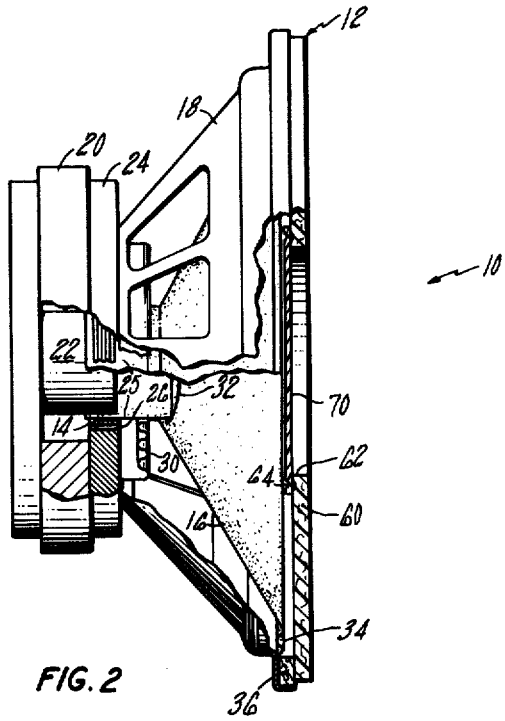
FIG. 2

LOUDSPEAKER HAVING APERTURED ACOUSTIC IMPEDANCE FRONTAL LOADING ELEMENT

DESCRIPTION

1. Technical Field

This invention relates to loudspeakers and more particularly to improved loudspeakers having apertured impedance frontal loading elements.

2. Background Art

Electrodynamic loudspeakers, especially those intended to be of low cost as for utilization in automobiles and the like, typically use small volume or low weight magnets for the diaphragm motor, resulting in a low damping factor on the moving system, quantitatively defined by "Q", resulting in a Q in excess of approximately 1.2. This low damping factor has a deleterious effect on the acoustical performance in the vicinity of the principal (lowest) resonant frequency of the moving system characterized by a peak in the steady state acoustical output, with a concomitant increase in harmonic and intermodulation distortion and impaired transient performance resulting in "ringing" of the system. The same low cost speakers with small magnets also typically utilize sound radiating diaphragms, commonly called cones, having a low mass characterized by a weight to area ratio typically in the 0.04–0.15 gm/in.$^2$ range, in order to maximize the efficiency. The low mass cone also tends to increase the amplitude of distributed mode resonances in the cone, which results in an increased sound output in the upper frequency range, i.e. above about 2,000 Hz, and which may not be desirable. A further performance problem in low cost, small size, low cone-mass loudspeakers is that the principal resonant frequency, $f_0$, which establishes the low frequency limit of performance in many applications, cannot be made as low as desired due to cone manufacturing limitations involved in felting the outer cone suspension areas sufficiently thin. The principal resonant frequency for a given mass cone is a function of the cone's suspension compliance which is in turn a function of the thickness of the suspension area of the cone.

The increased levels of sound output in the vicinity of the principal resonance frequency and in the upper frequency range of the loudspeaker are not always desirable performance attributes. A uniform or "flat" amplitude vs. frequency characteristics is often desired but difficult to achieve.

Various techniques for increasing the attenuation of the peak in the sound output in the vicinity of the principal resonant frequency and/or in the range of upper frequencies will be found in an article entitled "Acoustic Resistance Damping for Loudspeakers" by John L. Grauer in AUDIO, Vol. 49, No. 43, p.22, Mar. 1965; in U.S. Pat. No. 2,840,178 entitled "Device for the Reproduction of Sound"; and in U.S. Pat. No. 4,012,605 entitled "Input/Output Transducer with Damping Arrangement".

U.S. patent application Ser. No. 255,401 entitled "Improved Loudspeaker Having Acoustic Impedance Frontal Loading Element", filed on even date herewith and by the same inventor as herein, discloses an improved acoustic impedance arrangement for such relatively low cost loudspeakers, particularly for use in automobiles and other locations where they may experience high moisture and/or dust conditions. The acoustic impedance of such loudspeakers comprises a planar sheet of air-permeable fibrous felt which covers the projected frontal area of the speaker diaphragm and is supported only at the peripheral region thereof. The felt material has particular airflow resistance, density and thickness characteristics such that it provides attenuation of the acoustical output both at the principal resonant frequency and in the upper frequency range. Moreover, it reduces harmonic and intermodulation distortion and lowers the principal resonance frequency so as to extend the response range.

The acoustical impedance of the loudspeaker discussed in the immediately preceding paragraph provides desired damping of the loudspeaker cone motion in the vicinity of the principal resonant frequency. For the 12 oz. per sq. yard felt impedance element, significant attenuation of the acoustic output exists in the 2–5 kHz frequency range; however, the attenuation at frequencies above 5 kHz is particularly pronounced and with some cones having inherently diminished high frequency output the degree of high frequency attenuation may be undesirable if faithful reproduction of music and other sounds in those upper frequency ranges is required. On the other hand, for the 8 oz. per sq. yard felt impedance element the output in the higher frequencies above 5–8 kHz is as desired but the output exhibits excessive peaking in the 2–4 kHz range.

The aforementioned U.S. Pat. No. 2,840,178 refers to improving the high frequency response of a speaker by a centered aperture acting as an acoustic mass; however, no parameters are set forth and the acoustic resistance material is either a rigid disc of wire-net or an acoustic resistance material cemented to a perforated metal sheet. U.S. Pat. No. 2,646,851 also discusses the use of an aperture or slot in the area in front of the diaphragm, but such slot is for the purpose of defocusing the emanating sound waves and is formed in a surface which is presumably non-permeable to air.

It is a principal object of the present invention to provide an improved loudspeaker having acoustic impedance. Included within this object is the provision of acoustic impedance which results in a relatively flat response across a relatively wide frequency range.

It is another object of the present invention to provide an improved loudspeaker having acoustic impedance especially suited for use with loudspeakers in automotive applications requiring relative immunity to moisture and/or solid particulates.

It is a further object to provide an improved loudspeaker having acoustic impedance of relatively low-cost manufacture.

In accordance with the invention, there is provided in a direct radiator dynamic loudspeaker having a natural Q greater than about 1.2, improved acoustic impedance in the form of an apertured acoustic impedance element. The acoustic impedance element is formed principally of an apertured sheet of felt. A second sheet of acoustically transparent non-woven cloth is bonded to the felt so as to cover the aperture(s) therein. The felt sheet includes at least one aperture to facilitate the transmission of high frequency signals. Both sheets are preferably thermoplastics which are bonded to one another by limited heat staking around the at least one aperture in the felt sheet. The apertured sheet of felt has particular airflow resistance, density and thickness characteristics. The impedance element is supported only about its peripheral region in planar form. The resulting Q is less than about 1.2.

BRIEF DESCRIPTION OF THE DRAWINGS

FIG. 1 is a front elevational view of a loudspeaker including the acoustic impedance of the invention;

FIG. 2 is a side elevational view, partly in section, of the loudspeaker of FIG. 1.

BEST MODE FOR CARRYING OUT THE INVENTION

Figure 3:
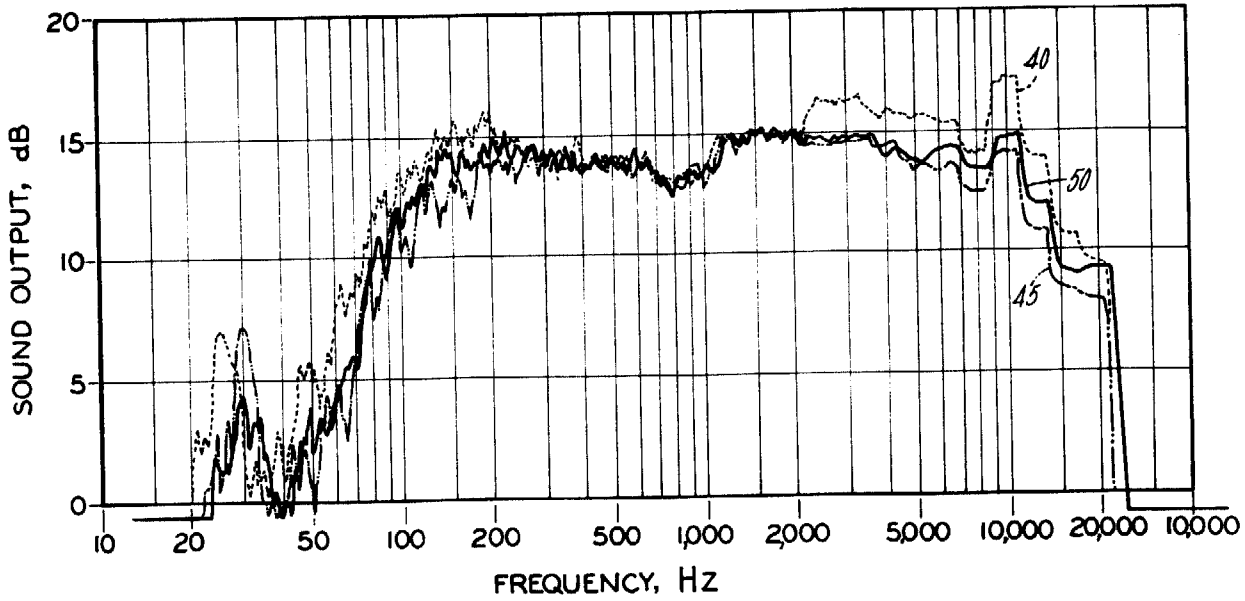
FIG. 3 is a graph illustrating the acoustic output vs. frequency response characteristics of similar loudspeakers with no acoustic damping, with a single continuous sheet of felt to provide acoustical impedance, and with the acoustic impedance element of the invention, respectively.

Referring to FIGS. 1 and 2, there is illustrated a 3½ inch loudspeaker 10 which includes the improved acoustic impedance element 12 of the invention. A loudspeaker 10 is of the direct radiator type and includes a moving voice coil 14 and a diaphragm in the form of cone 16. A frame or basket 18, generally of metal, serves as the principal structural member of the loudspeaker. The motor for cone 16 is formed by annular magnet 20 disposed about center pole 22 and rearwardly of front pole 24. The voice coil 14 concentrically encircles center pole 22 and is mounted on a cylindrical form 25 in annular air gap 26 between the annular front pole 24 and the center pole 22. the cone 16 is affixed at its apex end to the moving coil form 25 for axial displacement in response to the interaction of the variable electrical current through the coil 14 with the field of magnet 20. A voice coil centering suspension element 30, commonly called a spider, is secured both to the front pole 24 and to the coil form 25 for positioning and facilitating operation of the voice coil and the cone. A dust cap 32 covers the coil form 25. The base of cone 16 is suitably suspended from the annular rim of basket 18 by an annular compliance suspension 34 which may be unitary with the cone or separate therefrom.

The impedance element 12 of the invention is supported only at its periphery by being secured to the front surface of the annular rim of basket 18 through an intermediate gasket or pad ring 36. Pad ring 36 may be made of hot melt type material and is adhered to both the basket 18 and the impedance element 12 in a manner described in U.S. Pat. No. 4,191,865, also by the inventor of the present application.

The impedance element 12 is comprised of an apertured sheet of air-permeable fibrous felt material 60. A sheet of acoustically transparent non-woven cloth 70 covers at least the apertured area of felt material 60 in bonded facing relationship therewith. Both the fibrous felt material 60 and the non-woven cloth 70 are of thermoplastic materials to facilitate heat stake bonding, which will be hereinafter discussed in greater detail.

The apertured sheet of felt 60 is particularly selected to provide frequency selective acoustic damping and/or attenuation when placed over the front of cone 16. Although a plurality of apertures might be employed to advantage, the felt sheet 60 in the preferred embodiment includes a single aperture 62 having a diameter of about 1½ in. and being centrally positioned on the 3½ in. diameter of sheet 60. The non-woven cloth sheet 70 is typically thinner than felt sheet 60 and comprises a continuous, acoustically permeable sheet, or chemotextile, of non-woven thermoplastic material. The felt sheet 60 may suitably be polyester and the non-woven cloth 70 may be a viscose fiber such as cellulose acetate with an acrylic binder.

The felt sheet 60 preferably has an airflow resistance of about 100 cu. ft. per min. with a pressure drop of about 0.5 psi and a density in the range of 10–15 oz. per sq. yard, i.e. 11.5 oz. per sq. yard, and a nominal thickness in the range of 0.06–0.09 in., i.e. 0.075 in.

The thermoplastic cloth sheet 70 covering the aperture 62 in the felt sheet 60 is relatively thin, being in the range of about 0.01±0.002 in. and having a weight of about 1.0–1.4 oz. per sq. yard, to minimize its effect on the acoustic impedance of the element 12. Although acoustically permeable, the composition of non-woven sheet 70 is such as to be substantially water and dust impermeable, thereby isolating cone 16 from the deleterious effects of dirt and moisture. Covering sheet 70 is here illustrated as being located between the felt sheet 60 and cone 16, but it will be understood that it might be placed on the side of sheet 60 remote from cone 16.

In accordance with another aspect of the invention, the aperture-covering sheet 70 is bonded to the felt element 60 by heat staking at limited locations or regions of the element 12. It is preferable that the bonded area between sheets 60 and 70 be minimized to avoid excessive occlusion of the felt; however, bonding is required at least about the periphery of the aperture 62 in felt sheet 60. Accordingly, in the illustrated embodiment in which only a single, centered aperture 62 is in sheet 60, the covering sheet 70 extends only a small distance radially beyond the aperture and an annular heat stake bond 64 exists about the peripheral region of aperture 62. It is preferred to minimize the area which sheet 70 covers to minimize any interfering interaction between sheets 60 and 70 and the need for additional bonds, as well as to minimize the quantity of fabric required; however, it will be understood that sheet 70 may cover additional apertures in sheet 60 and might cover the entire sheet if required. The heat stake bonding of the two thermoplastic sheets 60 and 70 may be accomplished in a conventional manner, as by applying a contact tool heated to about 450° F. to the outer surfaces of the composite 12 for about 1 sec. While the bonding may be effected with a plurality of spot bonds, it is generally faster and less costly and therefore preferable to make peripheral bond 64 with a single continuous narrow bonding tool, thereby forming a continuous annular bond having a width of about 0.06 in.

A speaker 10 employing the impedance element 12 having the above described geometry and characteristics has been seen to noticeably increase the damping in the vicinity of the prpincipal resonant frequency, $f_0$, and to also significantly attenuate the amplitude of the acoustic response above 2,000 Hz relative to an undamped speaker. Additionally, this damping element lowers the principal resonant frequency, $f_0$, and both the harmonic and the intermodulation distortion in the sound output relative to an undamped speaker. Moreover, relative to a loudspeaker having acoustic impedance of the type described in the aforementioned U.S. application Ser. No. 255,401 for "Improved Loudspeaker Having Acoustic Impedance Frontal Loading Element", the present impedance element 12 with apertured felt sheet 60 maintains a relatively flat response in the 2–4 kHz range and above 5 kHz to frequencies in the range of 10–15 kHz. Thus, a relatively flat response is provided across a relatively wide frequency range.

Referring to FIG. 3, the acoustic output vs. frequency response of a conventional 3½ in. speaker with no acoustic damping element is depicted by dotted line 40. Similarly, the amplitude vs. frequency response of an identical speaker including a simple continuous impedance element of the type disclosed in the aforementioned U.S. application Ser. No. 255,401 entitled "Improved Loudspeaker Having Acoustic Impedance Frontal Loading Element", is depicted by the phantom line 45. Finally, the acoustic output vs. frequency response of an identical speaker 10 including the acoustic impedance element 12 of the invention is depicted by the solid line 50.

The frequency response 40 of a conventional non-damped speaker is seen to have a significant peak in the region of the principal resonant frequency, $f_0$, i.e. about 150 Hz, and a broad peak in the upper frequency range above about 1,000 Hz. The phantom line trace 45 on the other hand shows about a 5 dB decrease in acoustic sound pressure at the principal resonant frequency, $f_0$, which may represent an undesirable over-damped condition. Moreover, this over-damping is seen to extend into and to be even greater in the upper frequency ranges above about 2 kHz. Specifically, it will be noted that the output indicated by response curve 45 is about 6½ dB below that of response curve 50 at 10 kHz. It should be noted that the felt impedance element utilized in the loudspeaker which provided trace 45 had a density of 12 oz. per sq. yard and having an airflow resistance of 100 cu. ft. per min. A lighter felt having a density of 8 oz. per sq. yard and an airflow resistance of 50 cu. ft. per min. provides a response (not shown) which is better in the upper frequency range but which exhibits excessive peaking in the 2–4 kHz range.

Referring to trace 50 representing the response of the loudespeaker 10 employing impedance element 12 of the present invention, it is observed that the output level at the principal resonant frequency, $f_0$, of 150 Hz is intermediate that of response curves 40 and 45, having Q's of about 1.5 and 0.85 respectively, and exhibits approximately optimum damping for loudespeakers used in non-resonant enclosures, with $Q=0.97$. Importantly, trace 50 is intermediate the two response traces 40 and 45 in the range of 5–15 kHz. The response depicted by trace 50 in this upper frequency range is seen to flatten the overall response characteristic relative to the responses of the systems depicted by traces 40 and 45. Peaks in the response from $f_0$ through 10 kHz do not exceed about 1.5 dB relative to the 400 kHz level. This has the effect of extending the frequency band over which a high fidelity response may be expected.

Thus, it will be seen that utilization of the aforedescribed impedance element 12 with the speaker 10 results in a significant improvement in the measurable performance of the speaker relative both to non-damped speakers and to speakers having simple continuous impedance elements. Moreover, the use of thermoplastics and heat bonding techniques to form the covered-aperture impedance element 12 contribute to minimizing the manufacturing cost of an impedance element to be utilized with a relatively low-cost speaker. It will be appreciated, however, that the concepts and manufacturing techniques may find similar applicability to speakers of a variety of qualities and costs.

Although this invention has been shown and described with respect to detailed embodiments thereof, it will be understood by those skilled in the art that various changes in form and detail thereof may be made without departing from the spirit and scope of the claimed invention.

I claim:

1. A direct radiating dynamic loudspeaker of the type having low mass diaphragm and magnet means, the improvement comprising:

a substantially planar acoustic impedance means positioned in front of and covering the projected frontal area of said diaphragm, said impedance means being a nonrigid, fibrous air-permeable material supported only at the periphery thereof;

said impedance means having an opening therein providing an acoustic mass; and a second sheet of acoustically transparent material covering said opening and being bonded to said impedance means.

2. The loudspeaker of claim 1 wherein said impedance means comprises a sheet of felt.

3. The loudspeaker of claim 1 wherein said second sheet is composed of non-woven cloth.

4. The loudspeaker of claim 2 wherein said sheet of felt and said second sheet are synthetic materials.

5. The loudspeaker of claim 4 wherein said synthetic materials of both said sheet of felt and said second sheet are thermoplastics.

6. The loudspeaker of claim 5 wherein said first and second sheets of thermoplastic material are bonded together by heat staking.

7. The loudspeaker of claim 6 wherein heat stake bonding is accomplished around and near the opening in said impedance means.

8. The loudspeaker of claim 7 wherein said heat stake bonding is accomplished with a substantially continuous closed perimeter bond around the opening of said impedance means.

9. The loudspeaker of claim 1 wherein said second sheet is positioned intermediate said impedance means and said diaphragm to prevent the passage of solid particles through the opening in said impedance means.

10. The loudspeaker of claim 1 wherein the opening through said impedance means comprises a circular aperture axially aligned with the center of said diaphragm.

11. The loudspeaker of claim 2 wherein said diaphragm means is of low mass and said motor therefor is a low weight magnet means such that the normal Q of said loudspeaker is greater than about 1.2 and wherein said first sheet of felt has an airflow resistance of about 100 cubic foot per minute, a density in the range of 10–15 ounce per square yard and a thickness in the range of 0.06–0.09 inch, thereby resulting in a Q factor less than about 1.2.

12. The loudspeaker of claim 11 wherein said density of said felt sheet is about 11.5 ounce per square yard.

13. The loudspeaker of claim 5 wherein the thermoplastic material of the felt impedance means is composed of polyester and wherein the second sheet of acoustically transparent material is composed of cellulose acetate.

* * * * *